US007553182B2

(12) United States Patent
Buck et al.

(10) Patent No.: US 7,553,182 B2
(45) Date of Patent: Jun. 30, 2009

(54) ELECTRICAL CONNECTORS WITH ALIGNMENT GUIDES

(75) Inventors: Jonathan E. Buck, Hershey, PA (US); Donald K. Harper, Camp Hill, PA (US); Lee William Potteiger, Lewisberry, PA (US); John M. Spickler, Columbia, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/450,606

(22) Filed: Jun. 9, 2006

(65) Prior Publication Data

US 2007/0287336 A1 Dec. 13, 2007

(51) Int. Cl.
*H01R 13/64* (2006.01)

(52) U.S. Cl. ..... 439/378

(58) Field of Classification Search ..... 439/378, 439/74, 680, 701, 948, 858
See application file for complete search history.

(56) References Cited

U.S. PATENT DOCUMENTS 3,482,201 A * 12/1969 Schneck ..... 439/497
3,663,925 A * 5/1972 Proctor ..... 439/378
3,867,008 A * 2/1975 Gartland, Jr. ..... 439/857
4,232,924 A * 11/1980 Kline et al. ..... 439/74
4,482,937 A * 11/1984 Berg ..... 361/789
4,664,456 A * 5/1987 Blair et al. ..... 439/108
4,664,458 A * 5/1987 Worth ..... 439/82
5,055,054 A * 10/1991 Doutrich ..... 439/66
5,098,311 A * 3/1992 Roath et al. ..... 439/295
5,127,839 A * 7/1992 Korsunsky et al. ..... 439/79
5,181,855 A * 1/1993 Mosquera et al. ..... 439/74
5,382,168 A 1/1995 Azuma et al. ..... 439/65
5,395,250 A * 3/1995 Englert et al. ..... 439/65
5,697,799 A * 12/1997 Consoli et al. ..... 439/181
5,871,362 A * 2/1999 Campbell et al. ..... 439/67
5,893,761 A * 4/1999 Longueville ..... 439/66
5,902,136 A * 5/1999 Lemke et al. ..... 439/74
5,904,581 A * 5/1999 Pope et al. ..... 439/74
5,984,690 A * 11/1999 Riechelmann et al. ..... 439/66
5,992,953 A * 11/1999 Rabinovitz ..... 312/111
6,022,227 A * 2/2000 Huang ..... 439/79
6,152,747 A 11/2000 McNamara ..... 439/108
6,154,742 A 11/2000 Herriot ..... 707/10
6,241,535 B1 * 6/2001 Lemke et al. ..... 439/83
6,390,826 B1 * 5/2002 Affolter et al. ..... 439/70
6,494,734 B1 * 12/2002 Shuey ..... 439/378
6,835,072 B2 * 12/2004 Simons et al. ..... 439/66
6,869,292 B2 3/2005 Johnescu et al. ..... 439/74
6,893,300 B2 * 5/2005 Zhou et al. ..... 439/862

(Continued)

OTHER PUBLICATIONS

U.S. Appl. No. 10/940,329, filed Sep. 14, 2004, Johnescu, D.

(Continued)

*Primary Examiner*—T C Patel
*Assistant Examiner*—Vladimir Imas
(74) *Attorney, Agent, or Firm*—Woodcock Washburn LLP

(57) ABSTRACT

Electrical connectors of the present invention include alignment guides that provide rough connector alignment, vary an electrical contact mating wipe distance, and provide partial separation between two mating electrical connectors. The alignment guides can be, for example, electrically insulative posts that are received in silos formed in the housings of the electrical connectors.

38 Claims, 7 Drawing Sheets

U.S. PATENT DOCUMENTS

| | | | | |
|---|---|---|---|---|
| 6,902,411 | B2 * | 6/2005 | Kubo | 439/74 |
| 6,918,776 | B2 * | 7/2005 | Spink, Jr. | 439/74 |
| 6,939,173 | B1 * | 9/2005 | Elco et al. | 439/608 |
| 6,951,466 | B2 * | 10/2005 | Sandoval et al. | 439/74 |
| 2002/0127903 | A1 * | 9/2002 | Billman et al. | 439/378 |
| 2004/0157477 | A1 * | 8/2004 | Johnson et al. | 439/74 |
| 2005/0079763 | A1 * | 4/2005 | Lemke et al. | 439/582 |
| 2005/0101188 | A1 * | 5/2005 | Benham et al. | 439/620 |
| 2005/0277315 | A1 * | 12/2005 | Mongold et al. | 439/108 |
| 2006/0051987 | A1 * | 3/2006 | Goodman et al. | 439/74 |
| 2007/0004287 | A1 * | 1/2007 | Marshall | 439/701 |

OTHER PUBLICATIONS

U.S. Appl. No. 10/779,172, filed Feb. 11, 2004, Johnescu, D.

* cited by examiner

ELECTRICAL CONNECTORS WITH ALIGNMENT GUIDES

FIELD OF THE INVENTION

The present invention relates to a electrical connectors. More particularly, the invention relates to electrical connectors having stack heights and contact mating wipe distances that can be varied through the use of appropriately-sized alignment guides.

BACKGROUND OF THE INVENTION

Mezzanine connector systems typically comprise a plug connector and a receptacle connector that mates with the plug connector. An example is described in U.S. Pat. No. 6,152,747 to McNamara, herein incorporated by reference in its entirety.

The overall height of the mezzanine connector system in the direction of mating is commonly referred to as the stack height of the connector system. A specific stack height is often required for a particular application. If necessary, the stack height can be increased by the use of a spacer. For example, please see U.S. Pat. No. 6,869,292 to Johnescu et al., assigned to the applicant and herein incorporated by reference in its entirety.

SUMMARY OF THE INVENTION

The present invention includes alignment guides that provide rough connector alignment, vary an electrical contact mating wipe distance, and provide partial or fixed separation between two mating electrical connectors.

Preferred embodiments of electrical connectors comprise an electrically insulative housing and two or more electrical contacts carried by the housing. The two or more electrical contacts have free mating portions that extend in a first direction with respect to the housing and mounting portions that extend in a second direction through holes defined by the housing. The electrical connectors also comprise an alignment guide connected to the housing. The free mating portions of the two or more electrical contacts define a contact wipe distance, and the alignment guide limits the wipe distance to less than a maximum wipe distance.

Preferred embodiments of mezzanine connector systems comprise a receptacle connector comprising a first electrically insulative housing and a first electrically conductive contact mounted on the first housing, and a plug connector comprising a second electrically insulative housing and a second electrically conductive contact mounted on the second housing. The plug connector is matable with the receptacle connector in a first and a second mating position. The second contact wipes the first contact along a first distance of the first contact when the plug and receptacle connectors are mated to the first mating position. The second contact wipes the first contact along a second distance of the first contact greater than the first distance of the first contact when the plug and receptacle connectors are mated to the second mating position. At least one of the first and second housings has an alignment guide mounted thereon that prevents relative movement between the plug and receptacle connectors in a direction of mating as the plug and receptacle connectors reach the first mating position.

Preferred embodiments of electrical connectors capable of mating with a second electrical connector comprise an electrically insulative housing, a first electrically-conductive contact mounted on the housing, and an alignment guide that stops relative movement between the electrical connectors during mating thereof. The electrical connectors have a first stack height and the first contact is wiped by a contact of the second electrical connector by a first distance when the alignment guide is configured in a first state. The electrical connectors have a second stack height and the first contact is wiped by the contact of the second electrical connector by a second distance during mating when the alignment guide is configured in a second state.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION OF ILLUSTRATIVE EMBODIMENTS

Figure 1:
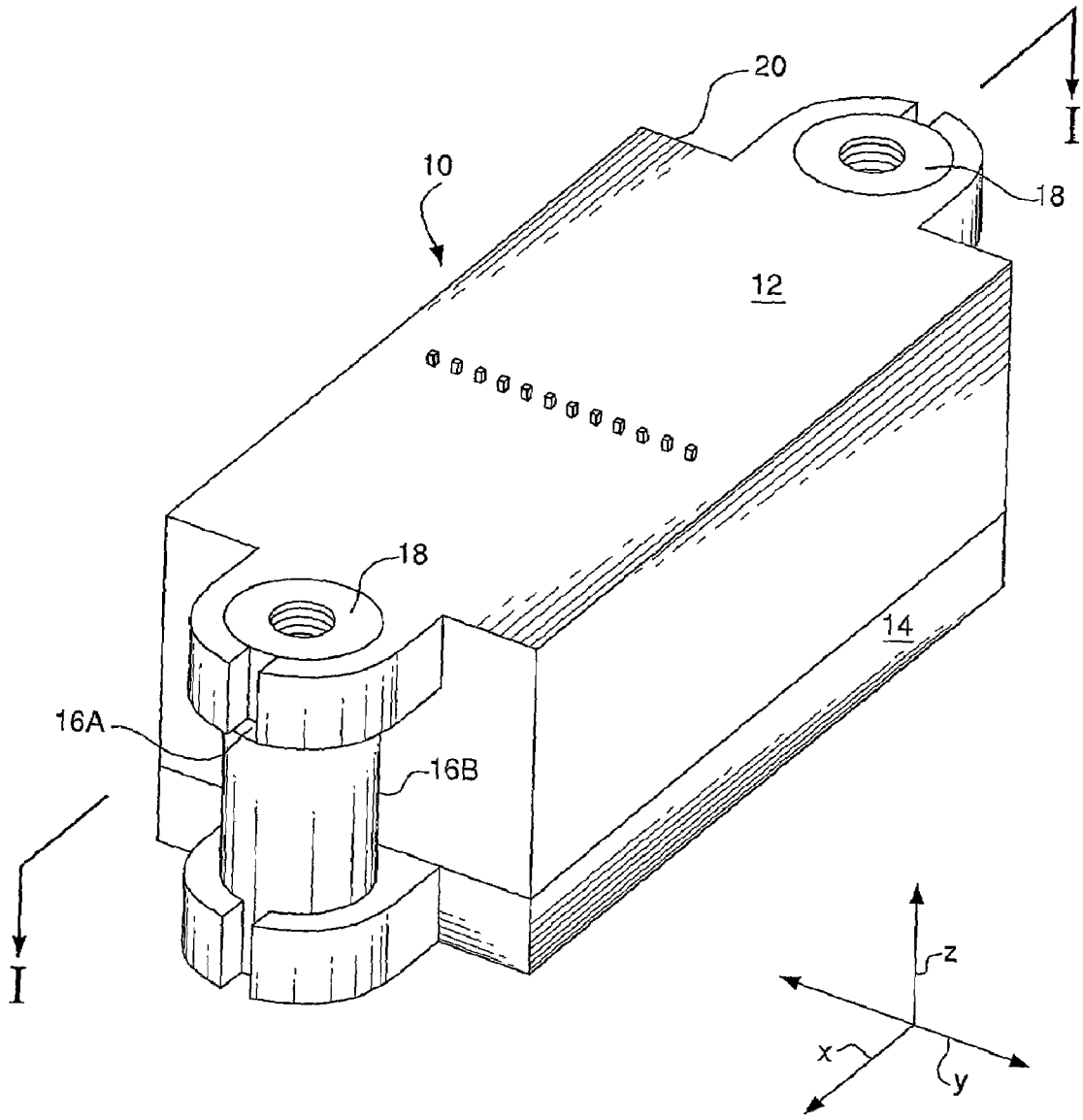
FIG. 1 is a perspective view of a mezzanine connector system with alignment and variable wipe distance features according to the present invention.

As shown in FIG. 1, a mezzanine connector system 10 according to one embodiment of the present invention includes a plug connector 12 and a receptacle connector 14 that mates with the plug connector 12. The plug connector 12 can be mounted on a first substrate, and the receptacle connector 14 can be mounted on a second substrate. The first and second substrates are not shown in the figures, for clarity of illustration. The plug and receptacle connectors 12, 14, upon mating, electrically connect the first and second substrates. The plug and receptacle connectors 12, 14 can be attached to two parallel substrates, and may be attached to the substrates by surface mount, ball grid array, press-fit, or other suitable types of terminations.

Figure 8:
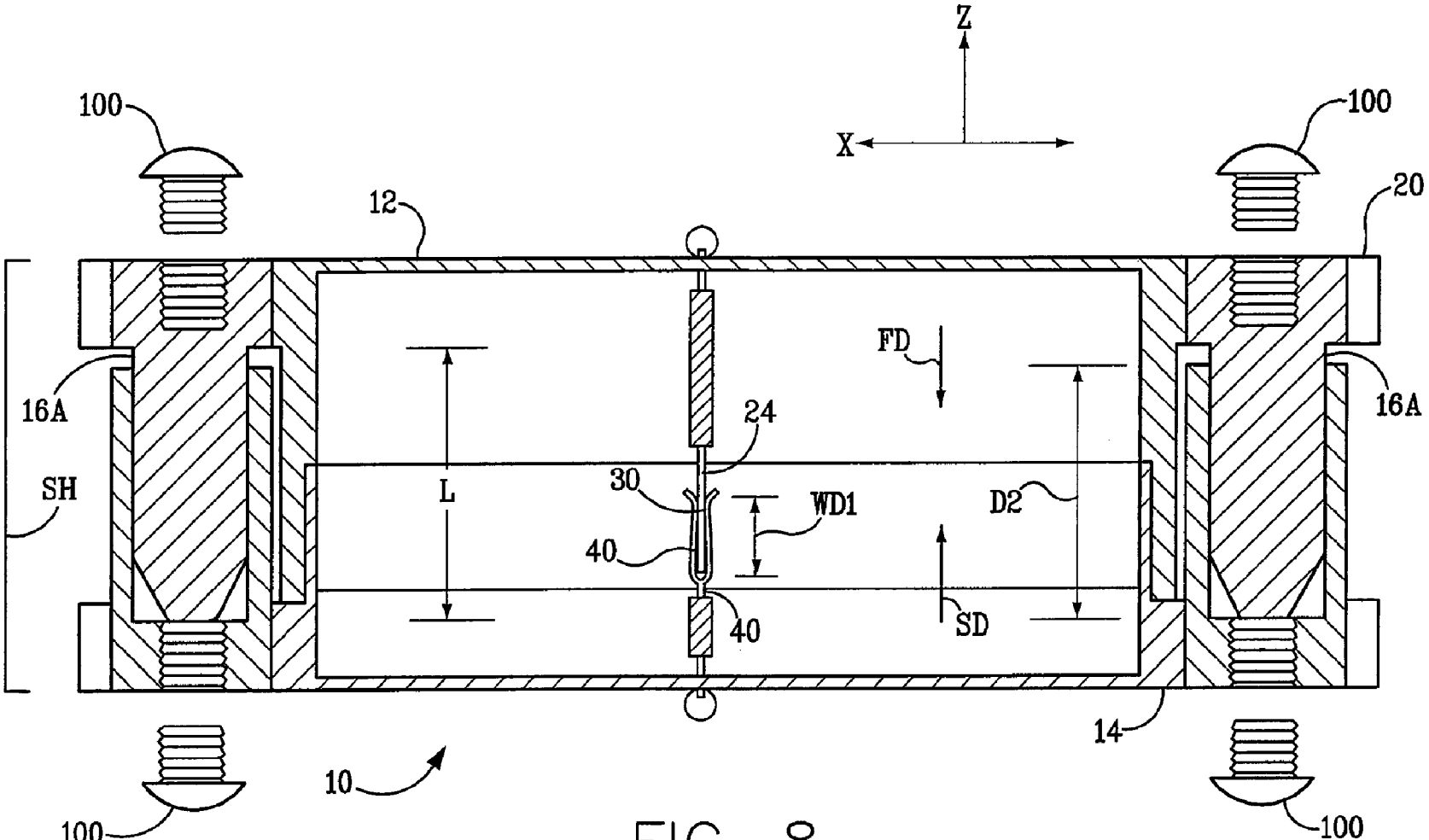
FIG. 8 is a cross-sectional view of the connector system shown in FIG. 4 with fasteners shown.

The present invention includes integrally formed or removable alignment guides that provide rough alignment, add space between the plug and receptacle connectors 12, 14, and help regulate contact wipe distance. The alignment guides are preferably one or more posts 16A received in one or more corresponding hollow silos 16B. Each post 16A preferably defines internal threads or may have a PEM nut 18, and can include a substrate fastener 100 (shown in FIG. 8) for holding the post 16A and the plug connector 12 to the first substrate. Each silo 16B likewise preferably defines internal threads or may have a PEM nut 18, and can include a substrate fastener (not shown) for holding the silo 16B and the receptacle connector 14 to the second substrate. Attaching the plug and receptacle connectors 12, 14 to the respective first and second substrates can discourage relative lateral movement between the first and second substrates when the plug and receptacle connectors 12, 14 are mated. The posts 16A are preferably removable from a plug housing 20 and may have a tapered or other suitable shape to help with rough alignment of the plug connector 12 and the receptacle connector 14.

Figure 2:
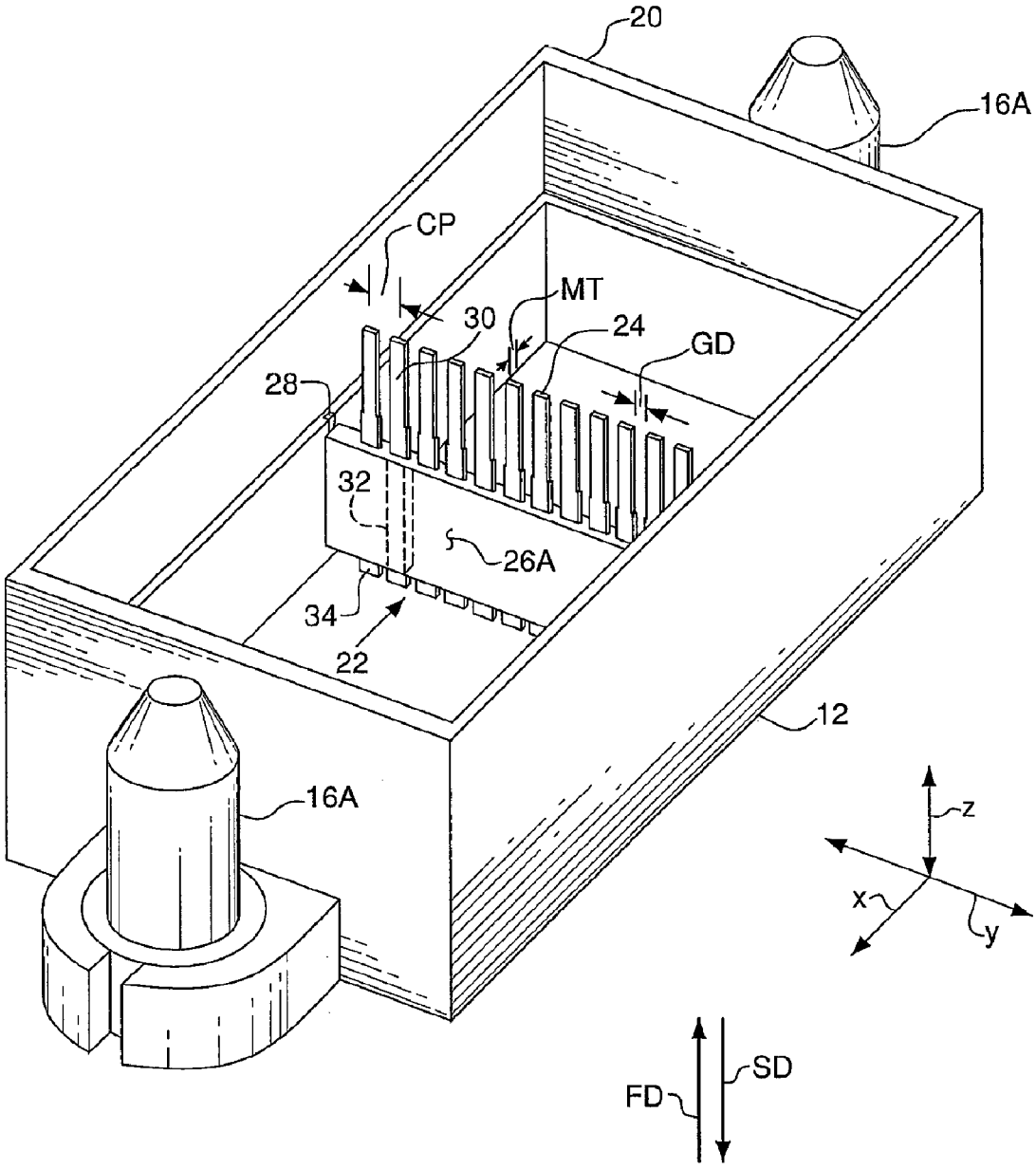
FIG. 2 is a perspective view of a plug connector shown in FIG. 1.

As shown in FIG. 2, the plug connector 12 includes one or more removable plug insert-molded lead frame assemblies (IMLAs) 22 that are preferably positioned parallel to one another inside of the plug housing 20. Each plug IMLA 22 comprises electrical plug contacts 24 that are electrically isolated from one another by a dielectric material, such as a plastic overmold 26A. The plug IMLAs 22 may be mounted on the plug housing 20 via an interference fit with the plug housing 20, by a tab and slot 28 arrangement, or other suitable manner of attachment. The plug IMLAs 22 are preferably spaced apart from each other by one to two millimeters.

The plug contacts 24 are spaced apart from one another by a gap distance GD. The gap distance GD is a function of dielectric material positioned in the gap distance GD and the material thickness MT of the plug contacts 24 themselves. For example, if the plug contacts 24 have a material thickness of about 0.1 to 0.4 mm, then the gap distance GD in air is about 0.1 to 0.4 mm for high speed differential signaling. A material thickness MT and a corresponding gap distance GD in air of about 0.2 mm is preferred. In plastic, the material thickness MT generally decreases and the gap distance GD increases. High speed signaling is generally defined herein as a bit rate above 2 Gigabits/sec, such as 3-20 Gigabits/sec. These bit rates generally correspond to rise times of about 200-30 ps with six percent or less of multiactive, worse-case crosstalk. The plug contacts 24 can also be configured to carry single-ended signals.

With continuing reference to FIG. 2, the plug contacts 24 can be arranged along a linear array within each plug IMLA 22, with a contact pitch CP of about 0.7 to 1.5 mm, with about 1 mm being preferred. The plug contacts 24 each include a free-ended plug mating portion 30, a plug intermediate portion 32 that adjoins the plug mating portion 30, and a plug mounting portion 34 that adjoins the plug intermediate portion 32. The plug mating portion 30, the plug intermediate portion 32, and the plug mounting portion 34 are substantially aligned in the z-direction. As noted below in connection with FIG. 3, the plug mating portions 30 are sized with respect to the plastic overmold 26A in a first direction FD to permit mechanical and electrical complementary mating with receptacle contacts in the receptacle connector 14 when the connector system 10 is disposed in different stack heights. The plug mounting portions 34 extend in a second direction SD through the plug housing 20 and a solder ball, press-fit tail, or other suitable termination is positioned adjacent to a mounting surface of the plug housing 20.

Figure 3:
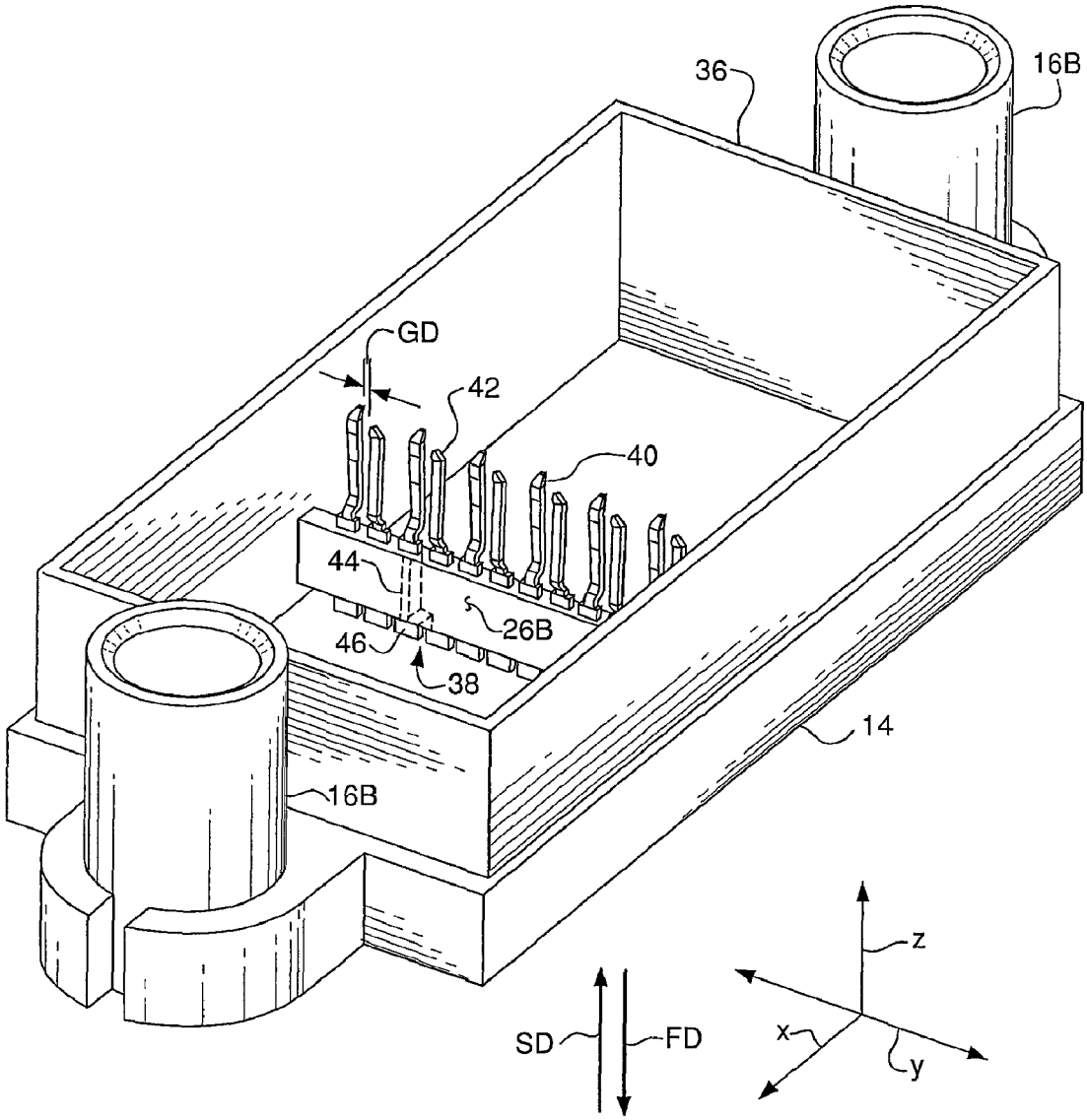
FIG. 3 is a perspective view of a receptacle connector shown in FIG. 1.

Referring now to FIGS. 1 and 3, the receptacle connector 14 is designed to electrically and mechanically mate with the plug connector 12. As shown in FIG. 3, the receptacle connector 14 includes a receptacle housing 36 with one or more silos 16B and one or more removable receptacle IMLAs 38 that are preferably positioned parallel to one another inside of the receptacle housing 36. Each receptacle IMLA 38 comprises free-ended electrical receptacle contacts 40 that are electrically isolated from one another by a dielectric material, such as plastic overmold 26B. The receptacle IMLAs 38 may be mounted on the receptacle housing 36 via an interference fit with the receptacle housing 36, by a tab and slot arrangement, or other suitable manner of attachment. The receptacle IMLAs 38 are preferably spaced apart 1 to 2 mm.

The receptacle contacts 40 preferably extend a fixed distance in a second direction SD from the plastic overmold 26B, and are spaced apart from one another by a gap distance GD, as discussed above with respect to the plug connector 12.

With continuing reference to FIG. 3, the receptacle contacts 40 can be arranged along a linear array within each receptacle IMLA 38, with a contact pitch of 0.7 to 1.5 mm, with one millimeter being preferred. The receptacle contacts 40 each include a receptacle mating portion 42, a receptacle intermediate portion 44 that adjoins the receptacle mating portion 42, and a receptacle mounting portion 46 that adjoins the receptacle intermediate portion 44. The receptacle mating portions 42 each extend along the z-axis in the second direction SD. The receptacle mating portions 42 are sized to permit mechanical and electrical complementary mating with the plug mating portions 30 of the plug contacts 24 shown in FIG. 2. As shown in FIG. 3, the receptacle mating portion 42 of each alternating receptacle contact 40 can extend along the x-axis. This allows for alternating surface mating with respective opposite sides of individual, adjacent ones of the plug contacts 24. The receptacle mounting portions 46 extend in the first direction through the receptacle housing and terminate in a solder ball or some other suitable substrate attachment.

Specific details of the IMLAs 22, 38 and the contacts 24, 40 are described for exemplary purposes only. The principles of the invention can be applied to connector systems comprising other types of IMLAs and contacts, and to connector systems that do not use IMLAs.

Figure 4:
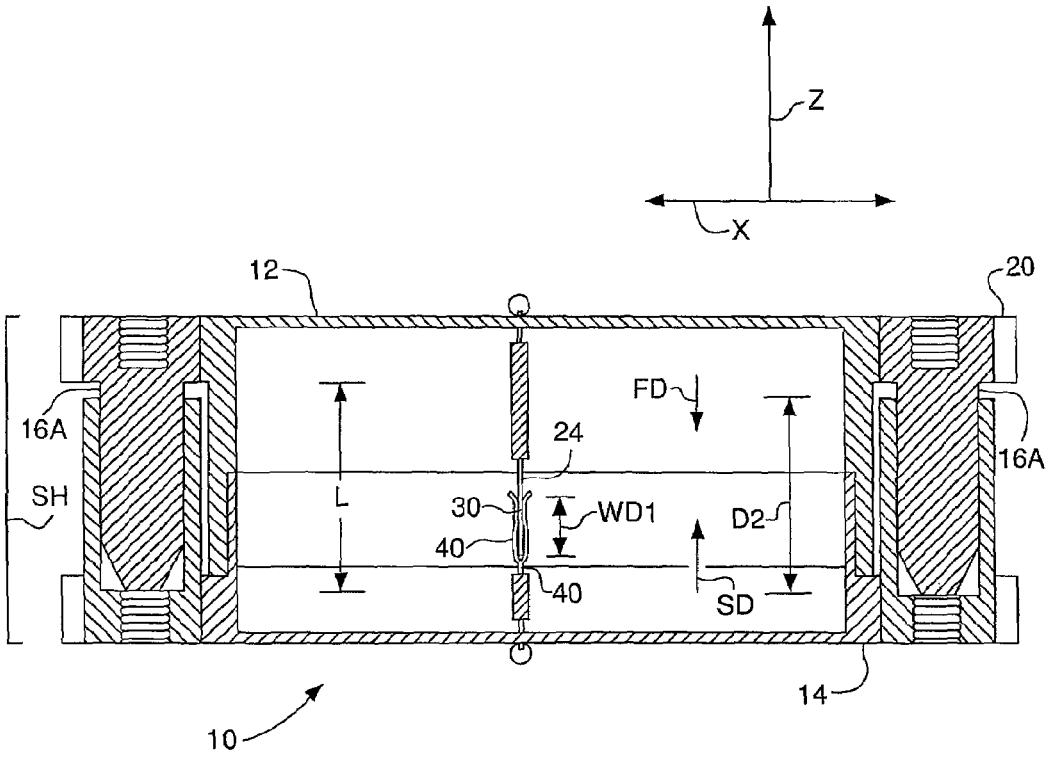
FIG. 4 is a cross-sectional view of the connector system shown in FIG. 1, taken along cross-section line I-I.

Turning to FIG. 4 and briefly recapping FIGS. 1-3, the plug housing 20 of the plug connector 12 is configured to retain one or more removable posts 16A. The receptacle housing 36 defines one or more silos 16B that receive individual ones of the posts 16A as the plug connector 12 is moved in the first direction FD toward the receptacle connector 14. The posts 16A and silos 16B act as an initial rough alignment between the plug connector 12 and receptacle connector 14 and ultimately restrain movement of the plug connector 12 in the first direction FD with respect to the receptacle connector 14 during mating of the plug and receptacle connectors 12, 14. The post or posts 16A can be sized in the first direction FD to produce a particular stack height SH and wipe distance WD1 for the mezzanine connector system 10.

Two substantially identical posts 16A are shown in FIG. 4. If the depth D2 of the silos remains constant, a length L of the posts 16A will define a first wipe distance WD1 between the plug mating portions 30 and the receptacle mating portions 40 of the respective plug and receptacle contacts 24, 40. Therefore, the posts 16A perform two duties—alignment and setting a particular mating portion wipe distance WD1. The wipe distance WD1 may be about 1-5 mm, with about 2-4 mm being preferred. Differing wipe distances can be obtained by varying the length L of the post or posts 16A and keeping the silo depth D2 constant.

Figure 5:
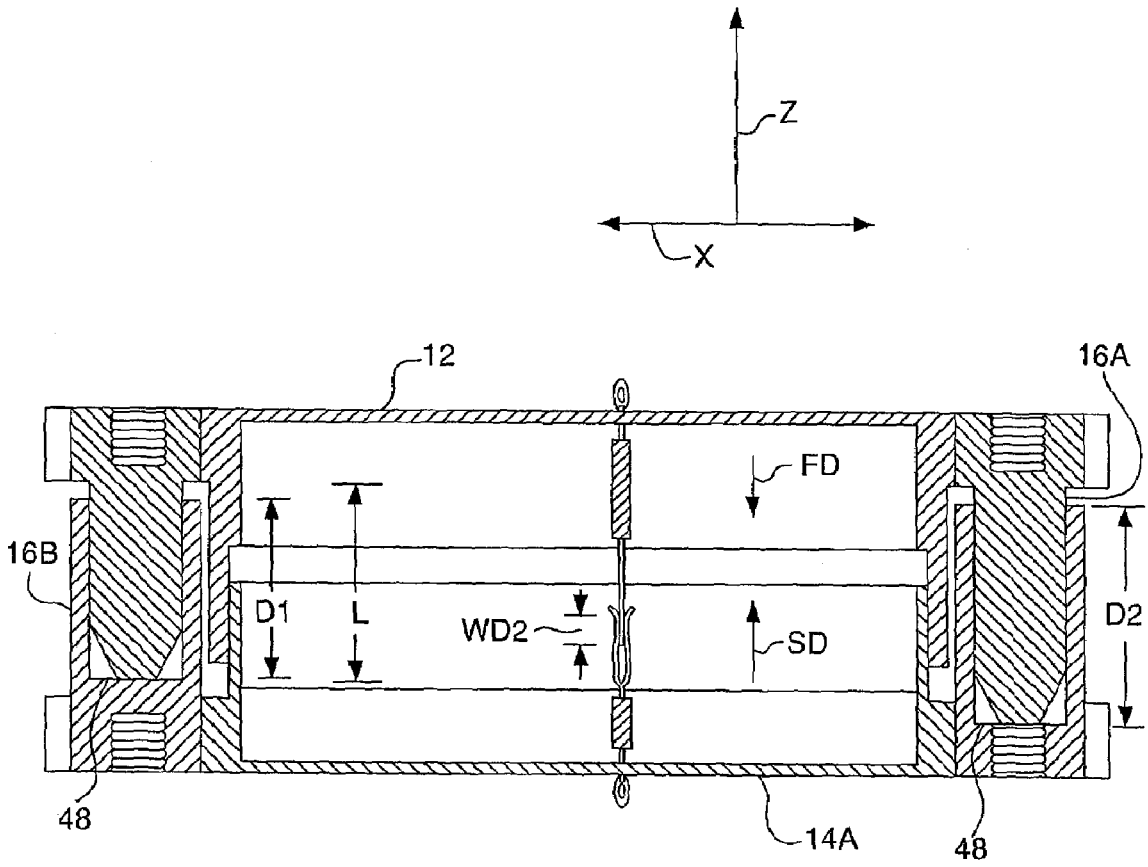
FIG. 5 cross-sectional view of a second embodiment mezzanine connector system according to the present invention.

Another embodiment of the present invention is shown in FIG. 5. In this embodiment, silos 16B have different depths D1, D2 in the first direction FD. Therefore, silos 16B that have differing depths may also be used to accomplish alignment and a desired wipe distance if the post 16A length L is constant. Stated another way, the present invention can decrease the depth D1, D2 of a silo base wall 48 instead of increasing the length of the posts 16A. As also shown in FIG. 5, depth D1 is less than depth D2. Therefore, post 16A is longer in the silo 16B with a depth of D2.

The present invention is not limited to solid posts 16A. Posts or other types of guides that telescopically expand or contract between different overall lengths can also be used.

Each telescoping post can be formed from two or more pieces. The pieces can be connected by way of threaded studs or other suitable means to facilitate the telescopic movement. Posts formed from interlocking pieces can also be used. The interlocking pieces can be stacked to form the post. The overall length L of the post can be increased or decreased by adding or removing one or more of the interlocking pieces to or from the stack.

Figure 6:
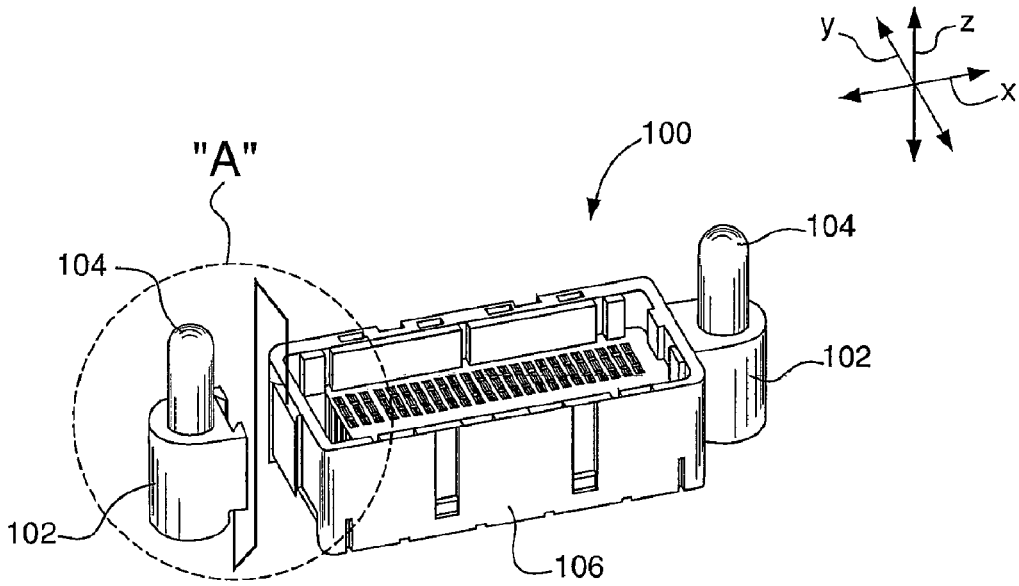
FIG. 6 is a perspective view of a third embodiment mezzanine connector system according to the present invention.
Figure 7:
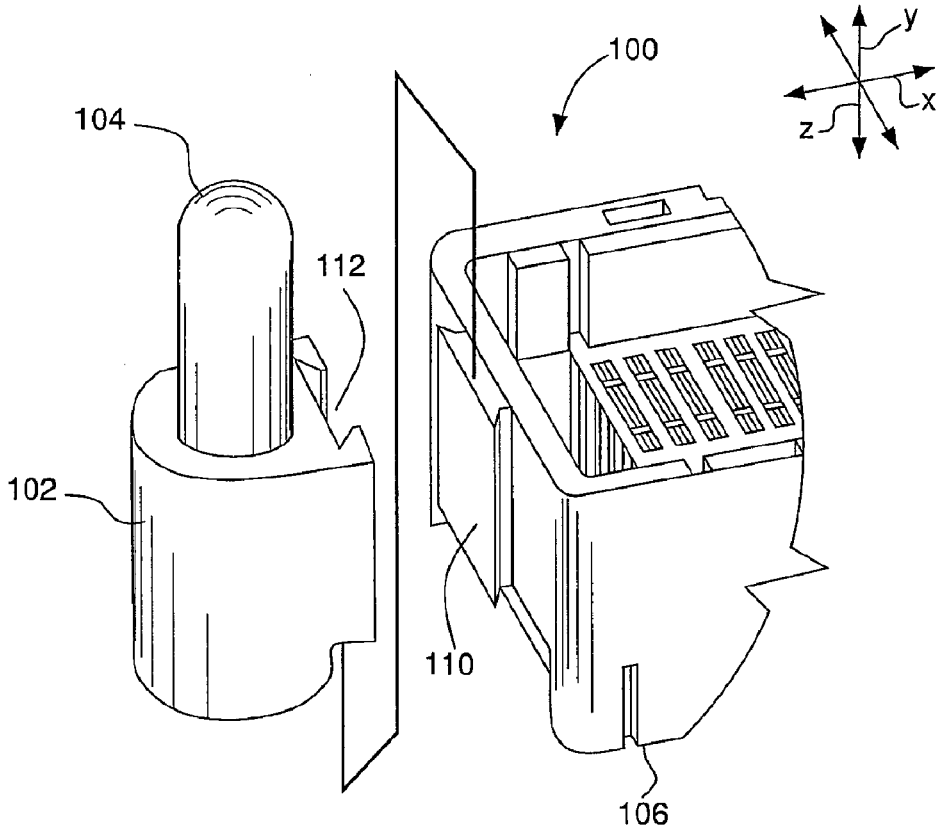
FIG. 7 is a magnified view of the area designated "A" in FIG. 6.

FIGS. 6 and 7 depict an alterative embodiment in the form of a connector 100. The connector 100 includes silos 102 each having an alignment post 104 mounted therein. The silos 102 are removably attached to a housing 106 of the connector 100 by a suitable means. For example, the housing 106 can include dovetails 110, and each silo 102 can have a slot 112 formed therein to receive an associated one of the dovetails 110.

The above-noted arrangement permits the connector 100 to be mounted on its mounting substrate without the alignment posts 104 touching the substrate. The alignment posts 104 can be mated with the housing 106, or can be moved downward on the housing 106 and into contact with the substrate once the connector 100 has been mounted using a reflow attachment process. The alignment posts 104 can be attached to the substrate by, for example, lock screw hardware that accesses the alignment pins 104 from on the opposite side of the substrate, or with a press-fit application to the substrate. Attaching the plug and receptacle portions of the connector to their respective mounting substrates discourages relative lateral movement between the substrates when the plug and receptacle connectors are mated.

Contact between the alignment posts 104 and the substrate can generate mechanical forces on the connector 100 that interfere with the ability of the connector 100 to self-center during the reflow attachment process, potentially degrading the reliability of the resulting solder connections. The ability to mount the connector 100 without contact between the alignment posts 104 and the substrate can eliminate the potential for such forces to occur.

What is claimed:

1. An electrical plug connector, comprising:

an electrically insulative plug connector housing defining a mounting end configured to engage a substrate, and a mating end disposed above the mounting end and configured to engage a mating electrical connector, and two or more electrical contacts carried by the housing, the two or more electrical contacts having free mating portions that extend in a first direction with respect to the housing, and mounting portions that extend in a second direction, and a housing wall disposed at the mounting end; and an alignment guide disposed proximal the housing and defining a first end disposed proximal the mounting end of the housing, and a second end disposed above the first end, wherein the first end does not extend below the housing wall, wherein the free mating portions of the two or more electrical contacts define a contact wipe distance, the housing includes an engagement edge configured to engage a complementary housing to define a maximum wipe distance, and the alignment guide limits the wipe distance to less than the maximum wipe distance.

2. The electrical connector as claimed in claim 1, wherein the alignment guide is an electrically insulated post that extends in the first direction beyond the mating portions of the two or more electrical contacts.

3. The electrical connector as claimed in claim 2, wherein the electrically insulated post is adjustable in length in the first direction and a second direction that is opposite to the first direction.

4. The electrical connector as claimed in claim 1, wherein the alignment guide is adjustable in length in the first direction and a second direction that is opposite to the first direction.

5. The electrical connector as claimed in claim 1, further comprising a second electrically insulative receptacle housing and two or more mating electrical contacts carried by the second housing, the two or more mating electrical contacts having second mating portions that electrically mate with the mating portions of the electrical contacts along the wiping distance.

6. The electrical connector as claimed in claim 5, wherein the alignment guide provides rough alignment for the electrically insulative plug connector housing and the second electrically insulative receptacle housing.

7. A mezzanine connector system, comprising:

a receptacle connector comprising a first electrically insulative housing and a first electrically conductive contact mounted on the first housing; and a plug connector comprising a second electrically insulative housing and a second electrically conductive contact mounted on the second housing, the plug connector being matable with the receptacle connector such that the first and second electrically conductive contacts wipe along a wiping distance;

wherein the first and second housings are configured to engage so as to define a maximum wiping distance between the first and the second contacts; and a first alignment member disposed proximal the first insulative housing, and a second alignment member disposed proximal the second insulative housing, wherein the first and second alignment members are configured to engage so as to align the first and second housings and to limit the wiping distance to a distance less than the maximum wiping distance.

8. The connector system as claimed in claim 7, wherein the plug and receptacle connectors have a first stack height when the plug and receptacle connectors are mated to a first mating position, and a second stack height shorter than the first stack height when the plug and receptacle connectors are mated to a second position.

9. The connector system as claimed in claim 7, wherein one of the alignment members is an electrically insulative post.

10. The connector system as claimed in claim 9, wherein the post is removably mounted on the at least one of the first and second housings.

11. The connector system as claimed in claim 8, wherein one of the alignment members is an electrically insulative post removably mounted on at least one of the first and second housings, and the plug and receptacle connectors can move from the first to the second mating position only when the post is not installed, whereby a wiping distance of the first and second contacts can be varied by removing the post.

12. The connector system as claimed in claim 9, wherein a length of the post in the direction of mating is adjustable.

13. The connector system as claimed in claim 7, wherein the alignment members provide rough alignment for the first and second housings.

14. The connector system as claimed in claim 7, wherein one of the alignment members is a hollow silo, the hollow silo defines a base wall, and the base wall is adjustable in height in the direction of mating.

15. A mezzanine connector system comprising:

a first electrically insulating housing supporting a first electrically-conductive contact mounted on the first housing;

a first alignment member disposed proximal the first housing;

a second electrically insulating housing supporting a second electrically-conductive contact mounted on the second housing, wherein the first and second housing are configured to move in a first direction relative to each other so as to connect the first and second electrically-conductive contacts; and a second alignment member disposed proximal the second housing and configured to engage the first alignment member so as to both 1) align the first and second electrically insulating housings, and 2) limit the movement of the housings along the first direction so as to define a stack height of the mezzanine connector.

16. The electrical connector as claimed in claim 15, wherein one of the alignment members is an electrically-insulative post.

17. The electrical connector as claimed in claim 16, wherein the first contact is wiped by the second contact by a first distance when the alignment member is configured in a first state, and the first contact is wiped by the contact of the second electrical connector by a second distance during mating when the alignment member is configured in a second state, and the post is mounted on the housing when the alignment member is configured in the first state, and the post is not mounted on the housing when the alignment member is configured in the second state.

18. The electrical connector as claimed in claim 17, wherein a length of the post is adjustable, the post has a first length when the alignment member is configured in the first state, and the post has a second length when the alignment member is configured in the second state.

19. The electrical connector as claimed in claim 15, wherein one of the alignment members is a hollow silo, the hollow silo defines a base wall that is adjustable in height, and the first contact is wiped by the second contact by a first distance when the base wall has a first height, and the first contact is wiped by the contact of the second electrical connector by a second distance during mating when the base wall has a second height different than the first height.

20. The electrical connector as claimed in claim 19, wherein the silo is removably attached to the housing.

21. A method for installing a connector on a substrate, the connector comprising a housing, an electrical contact mounted in the housing, a fusible element attached to the electrical contact, and an alignment guide disposed proximal the housing, the method comprising:

positioning the connector on the substrate such that the alignment guide is in alignment with the substrate;

aligning the fusible element with a solder pad on the substrate;

conducting a reflow operation that forms an electrical connection between the electrical contact and the solder pad; and subsequently moving the alignment guide toward the substrate.

22. The electrical connector of claim 1, further comprising two or more solder balls mounted respectively on the two or more electrical connectors.

23. The mezzanine connector system of claim 7, wherein the receptacle connector further comprises a first solder ball mounted on the first electrically conductive contact; and the plug connector further comprises a second solder ball mounted on the second electrically conductive contact.

24. The electrical connector of claim 15, further comprising a solder ball mounted on the first electrically-conductive contact.

25. The electrical connector of claim 1, wherein the alignment guide is connected to the housing.

26. The mezzanine connector system of claim 7, wherein engagement of the alignment members are configured to align the first and second housings prior to connecting the first and second contacts.

27. The A mezzanine connector system of claim 7, wherein the first alignment member is connected to the first insulative housing, and the second alignment member is connected to the second insulative housing.

28. The mezzanine connector system of claim 15 wherein the first alignment member is connected to the first housing, and the second alignment member is connected to the second housing.

29. A method of assembling a mezzanine connector system, the method comprising the steps of:

providing a first connector having a first electrically insulative housing, a first electrically conductive contact supported by the first housing, and a first alignment member disposed proximal the first housing;

providing a second connector having a second electrically insulative housing, a second electrically conductive contact supported by the second housing, and a second alignment member disposed proximal the second housing, wherein the first and second housings are configured to engage to provide a maximum wipe distance of the first contact along the second contact; and engaging the first alignment member with the second alignment member so as to align the first and second connectors and also to define an actual wipe distance of the first contact along the second contact that is less than the maximum wipe distance.

30. The method as claimed in claim 29, wherein the engaging step defines both a stack height of the mezzanine connector system and a wipe distance along which the second contact wipes the first contact.

31. The mezzanine connector system of claim 29, wherein the first alignment member is a post that defines a post length, wherein the second alignment guide is a silo that defines a silo depth, and wherein at least one of the post length and silo depth is adjustable.

32. The mezzanine connector system of claim 31, wherein the engaging step further comprising the step of fully inserting the post into the silo such that the distal end of the post abuts the base wall of the silo.

33. A method comprising the steps of:

providing an electrically insulative housing, and two or more electrical contacts carried by the housing, the two or more electrical contacts having free mating portions that extend in a first direction with respect to the housing and mounting portions that extend in a second direction through holes defined by a housing;

providing an alignment post or an alignment silo that is disposed proximal the housing;

adjusting a length of the post or a depth of the silo; and engaging the post or silo with an alignment member of a mating electrical connector prior to connecting the two or more electrical contacts with electrical contacts of the mating electrical connector, such that the post is fully inserted into the silo so that a distal end of the post abuts the base wall of the silo.

34. The electrical connector as claimed in claim 1, wherein the alignment guide is configured to remain connected to the electrically insulative housing when the housing is not engaged with the complementary housing.

35. The mezzanine connector system as claimed in claim 7, wherein the second alignment member is configured to remain connected to the second insulative housing when the first and second housing are not engaged.

36. The connector system as claimed in claim 7, wherein the first and second alignment members align the first and second housings before the first and second electrically conductive contacts are connected.

37. The mezzanine connector system as claimed in claim 15, wherein the a second alignment member engages the first alignment member so as to both align the first and second electrically insulating housings before the first and second electrically insulating housings are connected.

38. The method as recited in claim 29, wherein the engaging step further comprises aligning the first and second connectors prior to connecting the first and second connectors.

* * * * *